US009039160B2

(12) United States Patent
Nakajima

(10) Patent No.: US 9,039,160 B2
(45) Date of Patent: May 26, 2015

(54) IMAGE RECORDING APPARATUS AND IRRADIATOR

(75) Inventor: Mikito Nakajima, Ina (JP)

(73) Assignee: Seiko Epson Corporation, Tokyo (JP)

( * ) Notice: Subject to any disclaimer, the term of this patent is extended or adjusted under 35 U.S.C. 154(b) by 180 days.

(21) Appl. No.: 13/571,689

(22) Filed: Aug. 10, 2012

(65) Prior Publication Data

US 2013/0044172 A1 Feb. 21, 2013

(30) Foreign Application Priority Data

Aug. 15, 2011 (JP) ..... 2011-177677

(51) Int. Cl.
*B41J 2/01* (2006.01)
*B41J 11/00* (2006.01)

(52) U.S. Cl.
CPC ..... *B41J 11/002* (2013.01); *B41J 2202/09* (2013.01); *B41J 11/0015* (2013.01)

(58) Field of Classification Search
CPC .... B41J 11/002; B41J 11/0015; B41J 2/2114; B41J 2202/09; B41M 7/00; B41M 7/0027; B41M 5/0011
USPC ..... 347/102, 101; 101/488; 219/216; 346/25
See application file for complete search history.

(56) References Cited

U.S. PATENT DOCUMENTS 4,222,177 A * 9/1980 Mason ..... 34/278
6,517,180 B2 * 2/2003 Tullis et al. ..... 347/19
6,661,993 B2 * 12/2003 Bartscher et al. ..... 399/341
6,783,227 B2 8/2004 Suzuki et al.
8,008,694 B2 * 8/2011 Xu et al. ..... 257/290
8,054,553 B2 * 11/2011 Adler ..... 359/634
8,335,447 B2 * 12/2012 Maeda ..... 399/68
8,573,767 B2 * 11/2013 Edlitz et al. ..... 347/102
2002/0191310 A1 * 12/2002 Weigl et al. ..... 359/885
2003/0164872 A1 * 9/2003 Machida et al. ..... 347/187
2008/0151029 A1 * 6/2008 Yokoyama ..... 347/102
2008/0174648 A1 * 7/2008 Nakano et al. ..... 347/102
2008/0174649 A1 * 7/2008 Nakano et al. ..... 347/102
2009/0207223 A1 * 8/2009 Cofler et al. ..... 347/102
2009/0244711 A1 * 10/2009 Yokoyama et al. ..... 359/613
2009/0290159 A1 * 11/2009 Wihlborg ..... 356/418
2010/0264297 A1 * 10/2010 Kurahashi ..... 250/208.1

FOREIGN PATENT DOCUMENTS

JP 4238567 6/2004
JP 2004-181711 7/2004
JP 2004-188705 7/2004
JP 2004-284141 10/2004

(Continued)

*Primary Examiner* — Julian Huffman
*Assistant Examiner* — Leonard S Liang
(74) *Attorney, Agent, or Firm* — Workman Nydegger

(57) ABSTRACT

An image recording apparatus includes: a nozzle that discharges electromagnetic wave curable ink that is cured when an electromagnetic wave is irradiated onto a recording medium; and an irradiator for irradiating the electromagnetic wave, wherein a filter that transmits the electromagnetic wave is provided on the irradiator, and the filter has a first transmittance that causes the electromagnetic wave curable ink on the recording medium to be curable with respect to an electromagnetic wave that is incident at a first angle and a second transmittance that maintains a state in which the nozzle can discharge the electromagnetic wave curable ink with respect to an electromagnetic wave that is incident at a second angle.

10 Claims, 6 Drawing Sheets

(56) References Cited

FOREIGN PATENT DOCUMENTS

| | | | |
|---|---|---|---|
| JP | 4309688 | 10/2004 | |
| WO | WO 8801730 | A1 * | 3/1988 |
| WO | WO 03084767 | A3 * | 2/2004 |

* cited by examiner

| | PRESENCE OF FILTER | 45° TRANSMITTANCE WITH RESPECT TO 0° TRANSMITTANCE | DEGREE OF CURE OF UV INK | CLOGGING OF NOZZLES | ATTACHMENT AMOUNT OF UV INK ON NOZZLE OPENING FACE |
|---|---|---|---|---|---|
| COMPARATIVE EXAMPLE | NO | | ○ | × | × |
| EXAMPLE 1 | YES | EQUAL TO OR LESS THAN 50% | ○ | ○ | ○ |
| EXAMPLE 2 | YES | EQUAL TO OR LESS THAN 30% | ○ | ○○ | ○○ |
| EXAMPLE 3 | YES | EQUAL TO OR LESS THAN 10% | ○ | ◎ | ◎ |

FIG. 4A

<<FILTER OF EXAMPLE 1>>

| LAYER | MEMBER | THICKNESS (nm) |
|---|---|---|
| 1 | $Nb_2O_5$ | 63.61 |
| 2 | $SiO_2$ | 111.16 |
| 3 | $Nb_2O_5$ | 45.33 |
| 4 | $SiO_2$ | 106.23 |
| 5 | $Nb_2O_5$ | 50.62 |
| 6 | $SiO_2$ | 102.58 |
| 7 | $Nb_2O_5$ | 43.89 |
| 8 | $SiO_2$ | 118.04 |
| 9 | $Nb_2O_5$ | 27.29 |
| 10 | $SiO_2$ | 139.06 |
| 11 | $Nb_2O_5$ | 22.37 |
| 12 | $SiO_2$ | 133.74 |
| 13 | $Nb_2O_5$ | 20.22 |
| 14 | $SiO_2$ | 141.27 |
| 15 | $Nb_2O_5$ | 19.57 |
| 16 | $SiO_2$ | 136.17 |
| 17 | $Nb_2O_5$ | 18.14 |
| 18 | $SiO_2$ | 145.07 |
| 19 | $Nb_2O_5$ | 17.31 |
| 20 | $SiO_2$ | 304.98 |
| 21 | $Nb_2O_5$ | 18.96 |
| 22 | $SiO_2$ | 308.45 |
| 23 | $Nb_2O_5$ | 18.71 |
| 24 | $SiO_2$ | 95.96 |
| 25 | $Nb_2O_5$ | 16.02 |
| 26 | $SiO_2$ | 174.81 |
| 27 | $Nb_2O_5$ | 14.42 |
| 28 | $SiO_2$ | 99.70 |
| 29 | $Nb_2O_5$ | 19.64 |
| 30 | $SiO_2$ | 428.85 |
| 31 | $Nb_2O_5$ | 26.26 |
| 32 | $SiO_2$ | 79.28 |

| | REFRACTIVE INDEX |
|---|---|
| $Nb_2O_5$ | 2.403 |
| $SiO_2$ | 1.453 |

FIG. 4B

<<FILTER OF EXAMPLE 3>>

| LAYER | MEMBER | THICKNESS (nm) |
|---|---|---|
| 1 | $Nb_2O_5$ | 32.87 |
| 2 | $SiO_2$ | 129.14 |
| 3 | $Nb_2O_5$ | 35.60 |
| 4 | $SiO_2$ | 79.87 |
| 5 | $Nb_2O_5$ | 58.19 |
| 6 | $SiO_2$ | 53.32 |
| 7 | $Nb_2O_5$ | 66.22 |
| 8 | $SiO_2$ | 73.62 |
| 9 | $Nb_2O_5$ | 39.73 |
| 10 | $SiO_2$ | 103.00 |
| 11 | $Nb_2O_5$ | 27.25 |
| 12 | $SiO_2$ | 121.56 |
| 13 | $Nb_2O_5$ | 23.68 |
| 14 | $SiO_2$ | 114.90 |
| 15 | $Nb_2O_5$ | 24.79 |
| 16 | $SiO_2$ | 112.15 |
| 17 | $Nb_2O_5$ | 23.10 |
| 18 | $SiO_2$ | 121.36 |
| 19 | $Nb_2O_5$ | 18.11 |
| 20 | $SiO_2$ | 132.72 |
| 21 | $Nb_2O_5$ | 14.44 |
| 22 | $SiO_2$ | 127.15 |
| 23 | $Nb_2O_5$ | 11.94 |
| 24 | $SiO_2$ | 120.32 |
| 25 | $Nb_2O_5$ | 9.65 |
| 26 | $SiO_2$ | 124.64 |
| 27 | $Nb_2O_5$ | 11.68 |
| 28 | $SiO_2$ | 140.27 |
| 29 | $Nb_2O_5$ | 26.27 |
| 30 | $SiO_2$ | 48.03 |

| | REFRACTIVE INDEX |
|---|---|
| $Nb_2O_5$ | 2.409 |
| $SiO_2$ | 1.454 |

IMAGE RECORDING APPARATUS AND IRRADIATOR

BACKGROUND

1. Technical Field

The present invention relates to an image recording apparatus and an irradiator.

2. Related Art

One example of an image recording apparatus is an ink jet printer (hereinafter, printer) that includes a head on which nozzles that discharge ink that is cured by irradiating ultraviolet rays (electromagnetic waves) are provided. In the case of such a printer, there is a concern that the ultraviolet rays that are irradiated from an ultraviolet irradiation unit are reflected by a recording medium and the like, and the reflected ultraviolet rays reach a nozzle face of the head. In such a case, the ink at nozzle openings may be thickened or cured by the reflected ultraviolet rays, causing clogging of the nozzles.

Therefore, a method of arranging the ultraviolet irradiation unit and the head with a predetermined gap therebetween so that the reflected ultraviolet rays do not reach the nozzle face of the head has been proposed (for example, refer to JP-A-2004-284141).

However, with the method described in JP-A-2004-284141, the gap between the ultraviolet irradiation unit and the head increases, causing an increase in the size of the printer.

SUMMARY

An advantage of some aspects of the invention is that an image recording apparatus is miniaturized.

According to an aspect of the invention, there is provided an image recording apparatus including: a nozzle that discharges electromagnetic wave curable ink that is cured when an electromagnetic wave is irradiated onto a recording medium; and an irradiator for irradiating the electromagnetic wave, wherein a filter that transmits the electromagnetic wave is provided on the irradiator, and the filter has a first transmittance that causes the electromagnetic wave curable ink on the recording medium to be curable with respect to an electromagnetic wave that is incident at a first angle, and a second transmittance that maintains a state in which the nozzle can discharge the electromagnetic wave curable ink with respect to an electromagnetic wave that is incident at a second angle.

Other characteristics of the invention will be made clear in the present specification and description of the attached drawings.

BRIEF DESCRIPTION OF THE DRAWINGS

The invention will be described with reference to the accompanying drawings, wherein like numbers reference like elements.

FIG. 4A is a table that describes the specific configuration of the filter of Example 1, and FIG. 4B is a table that describes the specific configuration of the filter of Example 3.

DESCRIPTION OF EXEMPLARY EMBODIMENTS

Outline of Disclosure

Figure 1:
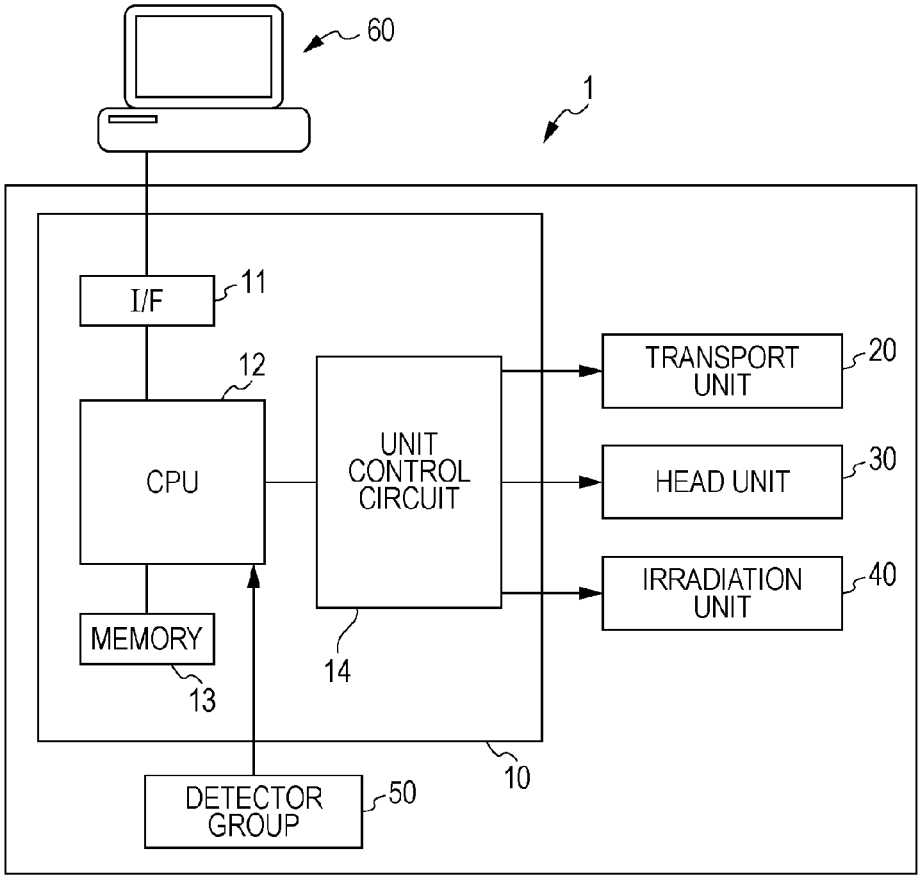
FIG. 1 is a block diagram that illustrates the configuration of a printing system.

At least the following will be made clear by the description of the specification and the description of the attached drawings.

That is, an image recording apparatus includes a nozzle that discharges electromagnetic wave curable ink that is cured when an electromagnetic wave is irradiated onto a recording medium and an irradiator for irradiating the electromagnetic wave, wherein a filter that transmits the electromagnetic wave is provided on the irradiator, and the filter has a first transmittance that causes the electromagnetic wave curable ink on the recording medium to be curable with respect to an electromagnetic wave that is incident at a first angle, and a second transmittance that maintains a state in which the nozzle can discharge the electromagnetic wave curable ink with respect to an electromagnetic wave that is incident at a second angle.

According to the image recording apparatus, since the electromagnetic wave curable ink on the recording medium can be cured and clogging of the nozzle can be prevented, a deterioration of the image can be prevented, and since there is no need to separate the nozzle from the irradiator, the image recording apparatus can be miniaturized.

In the image recording apparatus, the second transmittance may be lower than the first transmittance.

According to such an image recording apparatus, since the electromagnetic wave curable ink on the recording medium can be cured and clogging of the nozzle can be prevented, a deterioration of the image can be prevented, and since there is no need to separate the nozzle from the irradiator, the image recording apparatus can be miniaturized.

Further, there is provided an irradiator including a light source that can irradiate an electromagnetic wave for curing electromagnetic wave curable ink and a filter that transmits the electromagnetic wave, wherein the filter has a first transmittance with respect to an electromagnetic wave that is incident at a first angle and a second transmittance, which is lower than the first transmittance, with respect to an electromagnetic wave that is incident at a second angle.

According to the irradiator, for example, the transmittance of the electromagnetic wave that is reflected by the recording medium or the like and reaches the nozzle can be made lower than the transmittance of the electromagnetic wave that cures the electromagnetic wave curable ink on the recording medium.

There is provided an image recording apparatus including such an irradiator.

According to the image recording apparatus, since the electromagnetic wave curable ink on the recording medium can be cured and clogging of the nozzle can be prevented, a deterioration of the image can be prevented, and since there is no need to separate the nozzle from the irradiator, the image recording apparatus can be miniaturized.

In the image recording apparatus, in a case where the first angle is 0 degrees and the second angle is 45 degrees, the second transmittance may be equal to or less than 50% of the first transmittance.

According to the image recording apparatus, since the amount of the electromagnetic wave that is reflected by the recording medium or the like and reaches the electromagnetic wave curable ink can be made small without reducing the amount of the electromagnetic wave that is irradiated onto the electromagnetic wave curable ink on the recording medium, the electromagnetic wave curable ink on the recording medium can be cured while avoiding clogging of the nozzle.

In the recording apparatus, in a case where the first angle is 0 degrees and the second angle is 45 degrees, the second transmittance may be equal to or less than 30% of the first transmittance.

According to the image recording apparatus, since the amount of the electromagnetic wave that is reflected by the recording medium or the like and reaches the electromagnetic wave curable ink can be made small without reducing the amount of the electromagnetic wave that is irradiated onto the electromagnetic wave curable ink on the recording medium, the electromagnetic wave curable ink on the recording medium can be cured while avoiding clogging of the nozzle.

In the image recording apparatus, in a case where the first angle is 0 degrees and the second angle is 45 degrees, the second transmittance may be equal to or less than 10% of the first transmittance.

According to the image recording apparatus, since the amount of the electromagnetic wave that is reflected by the recording medium or the like and reaches the electromagnetic wave curable ink can be made small without reducing the amount of the electromagnetic wave that is irradiated onto the electromagnetic wave curable ink on the recording medium, the electromagnetic wave curable ink on the recording medium can be cured while avoiding clogging of the nozzle.

In the image recording apparatus, the wavelength of the electromagnetic wave may be equal to or greater than 390 nanometers and less than 410 nanometers.

According to the image recording apparatus, since the amount of the electromagnetic wave that is reflected by the recording medium or the like and reaches the electromagnetic wave curable ink can be made small without reducing the amount of the electromagnetic wave that is irradiated onto the electromagnetic wave curable ink on the recording medium, the electromagnetic wave curable ink on the recording medium can be cured while avoiding clogging of the nozzle.

In the image recording apparatus, the filter may be a multilayer filter.

According to the image recording apparatus, the transmittance of the electromagnetic wave that is incident at the first angle can be the first transmittance, and the transmittance of the electromagnetic wave that is incident at the second angle can be the second transmittance.

In the image recording apparatus, in the filter, in a case where the angle of the incident electromagnetic wave is 45 degrees, the transmittance of an electromagnetic wave with a wavelength of equal to or greater than 350 nanometers and less than 380 nanometers may be greater than the transmittance of an electromagnetic wave with a wavelength of equal to or greater than 390 nanometers and less than 410 nanometers.

According to the image recording apparatus, curing of the electromagnetic wave curable ink in the vicinity of the nozzle can be prevented while suppressing an increase in temperature in the vicinity of the irradiator.

Printing System

Embodiments will be described below with the "image recording apparatus" as an ink jet printer (hereinafter printer) with a printing system in which the printer and a computer are connected to each other as an example.

Figure 2:
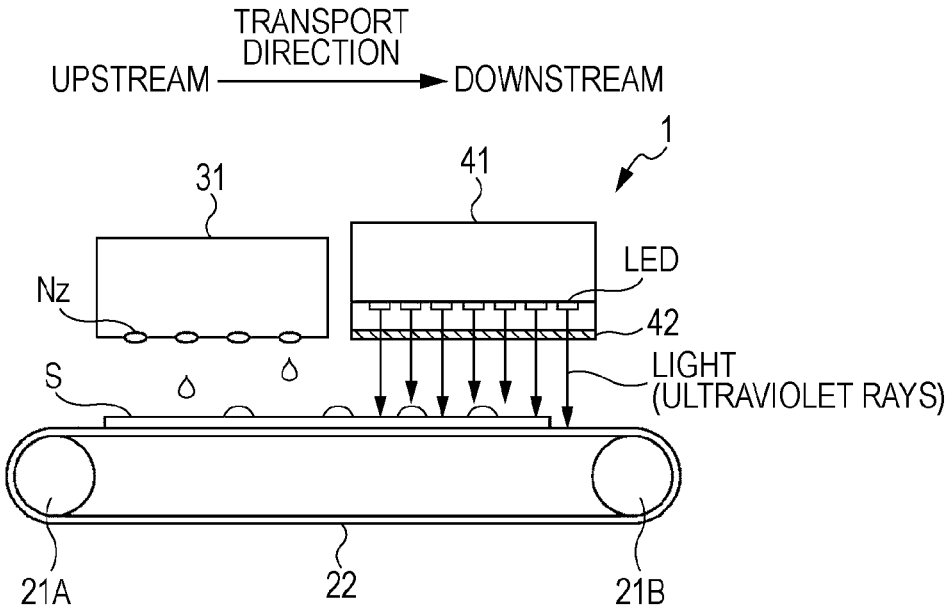
FIG. 2 is an outline cross-sectional view of a printer.

FIG. 1 is a block diagram that illustrates the configuration of the printing system, and FIG. 2 is an outline cross-sectional view of a printer 1. The printer 1 of the present embodiment prints (records) an image on a recording medium such as paper, fabric, or film using ink (equivalent of "electromagnetic wave curable ink", hereinafter referred to as "UV ink") that is cured by the irradiation of ultraviolet rays (electromagnetic waves). The UV ink is ink that includes an ultraviolet curable resin in addition to a pigment, and is cured by a photopolymerization reaction taking place in the ultraviolet curable resin as the irradiation of ultraviolet rays is received.

A computer 60 is connected to be able to communicate with the printer 1, and outputs printing data for the printer 1 to print an image to the printer 1.

A controller 10 within the printer 1 is for performing overall control of the printer 1. An interface unit 11 performs transceiving of data with the computer 60, which is an external apparatus. A CPU 12 is a computation processing apparatus for performing overall control of the printer 1, and controls each unit via a unit control circuit 14. A memory 13 is for securing an area in which the program of the CPU 12 is stored, a work area, and the like. Further, a detector group 50 monitors the status within the printer 1, and the controller 10 controls each unit based on the detection results.

A transport unit 20 is for transporting the recording medium (hereinafter, medium S) from the upstream side of the transport direction to the downstream side. As illustrated in FIG. 2, the medium S is transported on a transport belt 22 that is rotated by transport rollers 21A and 21B while opposing the lower faces of a head 31 and an ultraviolet irradiation unit 41, at a fixed speed without stopping.

The head unit 30 includes the head 31 that discharges UV ink to the opposing medium S. On the lower face of the head unit 31, a multitude of nozzle openings Nz that discharge the UV ink are lined up in a direction that intersects the transport direction. Therefore, when the UV ink is discharged from the nozzle openings Nz toward the medium S that is moved under the head 31 in the transport direction, a two-dimensional image in which a plurality of dot rows along the transport direction are lined up in a direction that intersects the transport direction is printed. Here, the method of ink discharge from the nozzle may be a piezo method of discharging ink by expanding and contracting an ink chamber that is communicated with the nozzle by applying a voltage to a driving element (piezo element), or a thermal method of generating bubbles within the nozzle using a driving element (heating element) and discharging ink using the bubbles.

An irradiation unit 40 includes the ultraviolet irradiation unit 41 (irradiator) that cures UV ink by irradiating ultraviolet rays on UV ink that lands on the medium S. In the embodiment, a light emitting diode (LED) is used as the irradiation light source of the ultraviolet rays, and a plurality of LED packages are provided on the lower face of the ultraviolet irradiation unit 41 (opposing face with respect to the medium S). Here, the irradiation light source of the ultraviolet rays is not limited to an LED and may, for example, be a metal halide lamp or a mercury lamp. Further, a filter 42 that transmits light is provided on the ultraviolet irradiation unit 41 to cover the LED packages (details will be described later).

Here, in a case where the printer 1 discharges UV inks of a plurality of colors, color mixing and bleeding of the UV ink may be prevented by providing an ultraviolet irradiation unit 41 between heads 31 that discharge the UV ink of each color. Further, ultraviolet irradiation units 41 (provisional irradiation units) that irradiate ultraviolet rays at levels that do not completely cure the UV ink may be arranged between the heads 31, and an ultraviolet irradiation unit 41 (main irradiation unit) that completely cures the UV ink may be arranged to the most downstream side of the transport direction.

Ultraviolet Irradiation Unit 41

Figures 3A, 3B:
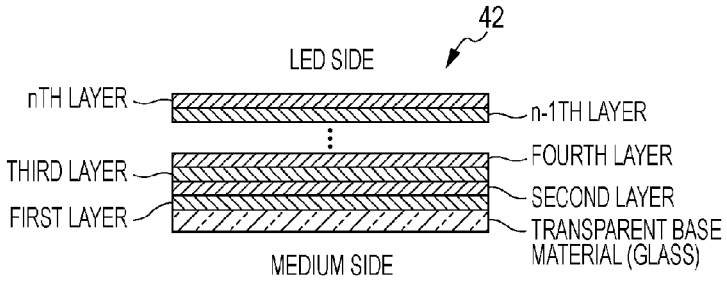
FIG. 3A is a table that illustrates the evaluation results of the ultraviolet irradiation units of Comparative Example and Examples.
FIG. 3B is a view that describes the configuration of a filter.

FIG. 3A is a table that illustrates the evaluation results of the ultraviolet irradiation units 41 of Comparative Example and Examples 1 to 3, and FIG. 3B is a view that describes the configuration of the filter 42 that is provided on the ultraviolet irradiation units 41 of Examples 1 to 3.

FIG. 4A is a table that describes the specific configuration of the filter 42 of Example 1, and FIG. 4B is a table that describes the specific configuration of the filter 42 of Example 3.

Figure 5A:
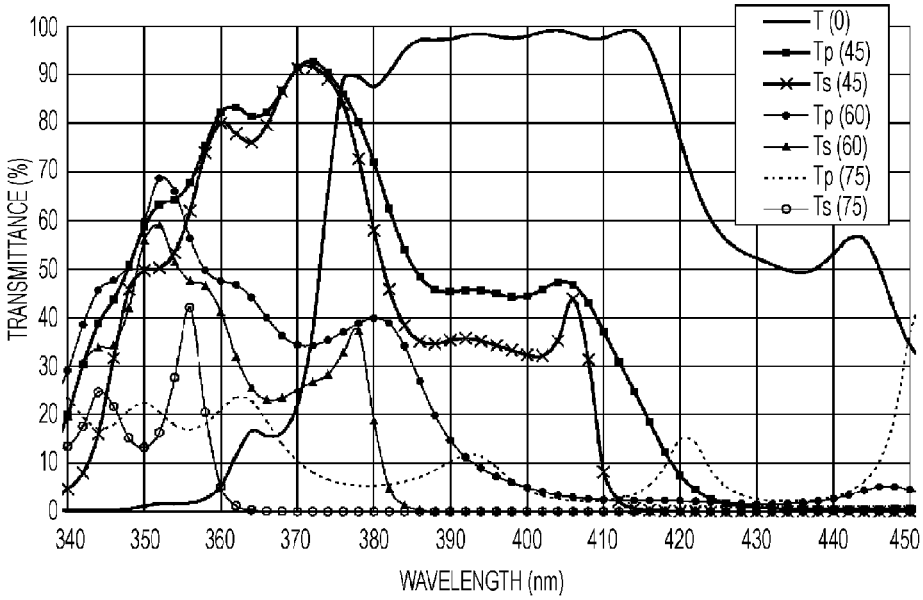
FIG. 5A is a graph that illustrates the transmittance with respect to light of each wavelength through the filter of Example 1.
Figure 5B:
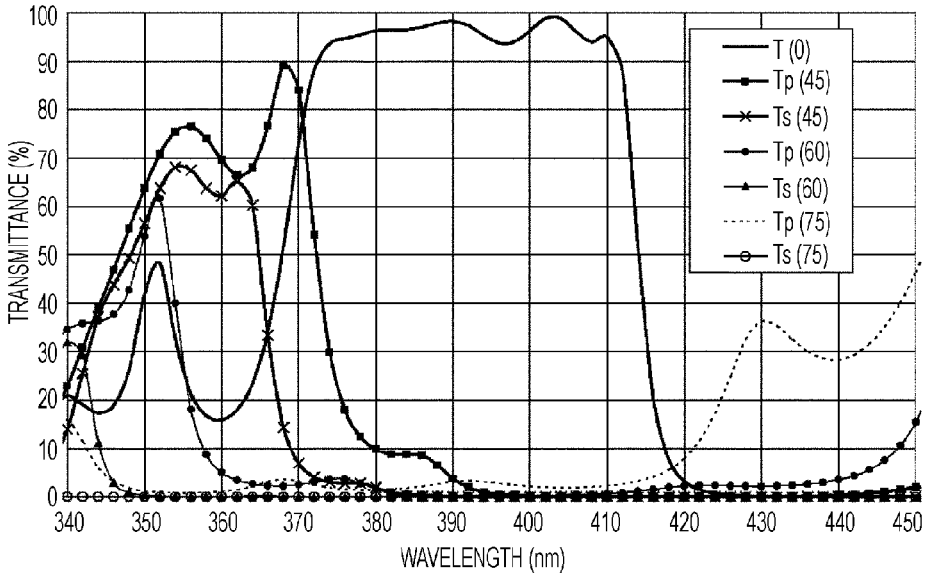
FIG. 5B is a graph that illustrates the transmittance with respect to light of each wavelength through the filter of Example 3.

FIG. 5A is a graph that illustrates the transmittance of light (electromagnetic waves) with respect to each wavelength through the filter 42 of Example 1, and FIG. 5B is a graph that illustrates the transmittance of light with respect to each wavelength through the filter 42 of Example 3.

Figure 6A:
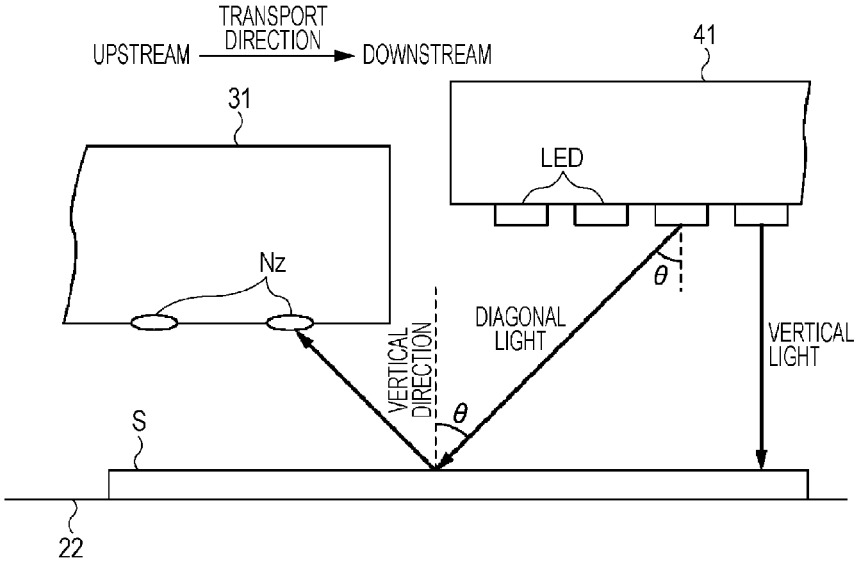
FIG. 6A is a view that illustrates the pathway of light that is irradiated from the ultraviolet irradiation unit of Comparative Example.
Figure 6B:
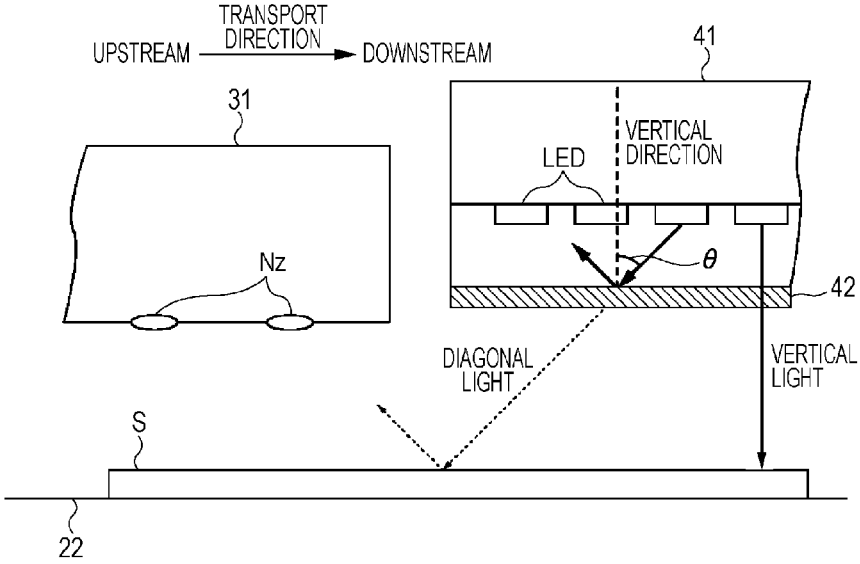
FIG. 6B is a view that illustrates the pathway of light that is irradiated from the ultraviolet irradiation unit of Examples.

FIG. 6A is a view that illustrates the pathway of light that is irradiated from the ultraviolet irradiation unit 41 of Comparative Example, and FIG. 6B is a view that illustrates the pathway of light that is irradiated from the ultraviolet irradiation units 41 of Examples 1 to 3.

In the graphs of FIGS. 5A and 5B, the horizontal axis indicates the wavelength (nm=nanometers) of the light that is irradiated from the ultraviolet irradiation unit 41 (LED package), and the vertical axis indicates the transmittance (%) of the light. In each graph, a transmittance T (0) of light with an incident angle of 0 degrees with respect to the filter 42 is indicated by a thick line, a transmittance Tp (45) of p polarization components of light with an incident angle of 45 degrees is indicated by a thick line and squares (■), a transmittance Ts (45) of s polarization components is indicated by a thick line and crosses (x), a transmittance Tp (60) of p polarization components of light with an incident angle of 60 degrees is indicated by a thin line and black circles (●), a transmittance Ts (60) of s polarization light is indicated by a thin line and triangles (▲), a transmittance Tp (75) of p polarization components of light with an incident angle of 75 degrees is indicated by a dotted line, and a transmittance Ts (75) of s polarization components is indicated by a thin line and white circles (○).

Ultraviolet Irradiation Unit 41 of Comparative Example

As illustrated in FIGS. 3A and 6A, the ultraviolet irradiation unit 41 of Comparative Example does not include the filter 42, and the LED package is in an exposed state. That is, the light that is irradiated from the LED package is irradiated directly onto the UV ink on the medium S. Here, the LED package may also be covered only by a glass base material, and the same evaluation results as in FIG. 3A are also obtained in such a case.

Ultraviolet Irradiation Units 41 of Examples 1 to 3

As illustrated in FIGS. 3A and 6B, the ultraviolet irradiation unit 41 of Examples 1 to 3 includes the filter 42, and the LED package (irradiation face) is covered by the filter 42. That is, the filter 42 intervenes between the LED package and the medium S, and out of the light that is irradiated from the LED package, light that is transmitted through the filter 42 is irradiated on the UV ink on the medium S.

As illustrated in FIG. 3B, the filter 42 is a "multilayer filter" in which a plurality of thin films with different materials and thicknesses are laminated on a transparent base material. While the transparent base material is glass in the present embodiment, without being limited thereto, plastics, crystals, and the like, for example, may be the transparent base material. For the sake of description, the thin films in order from the transparent base material side are the first layer, the second layer, . . . the nth layer. Further, the filter 42 is attached to the ultraviolet irradiation unit 41 so that the transparent base material side is the medium S side and the opposite side (nth layer side) of the transparent base material is the LED package side.

As illustrated in FIG. 6B, while the filter 42 that is provided on the ultraviolet irradiation units 41 of Examples 1 to 3 transmits, out of the light that is irradiated from the LED package, a large portion of the "vertical light (light with an incident angle of 0 degrees)" along the vertical direction of the filter 42 and the surface of the medium S, only a portion of "diagonal light" that is incident on the filter 42 and the medium S with an angle θ (equal to or greater than 45 degrees in the embodiment) with respect to the vertical direction is transmitted.

Further, an LED package with a peak wavelength of 395 nm is provided in the ultraviolet irradiation unit 41 of the embodiment. Furthermore, a wavelength range centered on 395 nm (for example, 395 nm±20 nm) is included in the wavelength range that acts on the curing of the UV ink (ultraviolet curable resin) used in the embodiment.

The filter 42 of Examples 1 to 3 will be described in detail below.

As illustrated in FIG. 5A, in the filter 42 that is provided on the ultraviolet irradiation units 41 of Example 1, within a wavelength range of at least equal to or greater than 390 nm and less than 410 nm, the transmittance T (0) of light with an incident angle of 0 degrees (vertical light) is equal to or greater than 90%, and the transmittances Tp (45) and Ts (45) of light with an incident angle of 45 degrees (diagonal light) are equal to or less than 50%. Furthermore, within a wavelength range of at least equal to or greater than 390 nm and less than 410 nm, the transmittances Tp (45) and Ts (45) of light with an incident angle of 45 degrees are "equal to or less than 50%" of the transmittance T (0) of light with an incident angle of 0 degrees.

That is, a filter 42 with which the transmittance (second transmittance) of light (electromagnetic waves) with an incident angle of 45 degrees (second angle) which is a wavelength that cures the UV ink is equal to or less than 50% of the transmittance (first transmittance) of light with an incident angle of 0 degrees (first angle) which is a wavelength that cures the UV ink is provided on the ultraviolet irradiation unit 41 of Example 1.

Further, without being limited to diagonal light with an incident angle of 45 degrees, even in relation to diagonal light with incidents angles of 60 degrees and 75 degrees, as illustrated in FIG. 5A, the transmittances Tp (60), Ts (60), Tp (75), and Ts (75) are equal to or less than 50% (approximately equal to or less than 10%) within a wavelength range of at least equal to or greater than 390 nm and less than 410 nm. Furthermore, the transmittances of light with incident angles of 60 degrees and 75 degrees, the transmittance T (0) of light with an incident angle of 0 degrees is "equal to or less than 50%".

As illustrated in FIG. 4A, a filter 42 with such transmittances (characteristics of FIG. 5A) is formed by alternately overlapping thin films of $Nb_2O_5$ (niobium pentoxide) and thin films of $SiO_2$ (silicon dioxide) up to 32 layers thick. The thickness of each thin film is different, and as illustrated in FIG. 4A, for example, the thickness of the thin layer of the first layer is 63.61 nm and the thickness of the thin layer of the second layer is 111.16 nm. Further, the refractive index of an $Nb_2O_5$ thin film is 2.403 at a wavelength of 395 nm, and the refractive index of an $SiO_2$ thin film is 1.453.

As illustrated in FIG. 5B, in the filter 42 that is provided on the ultraviolet irradiation unit 41 of Example 3, within a wavelength range of at least equal to or greater than 390 nm and less than 410 nm, the transmittance T (0) of light with an incident angle of 0 degrees (vertical light) is equal to or greater than 90%, and the transmittances Tp (45) and Ts (45) of light with an incident angle of 45 degrees (diagonal light) are equal to or less than 10%. Furthermore, within a wavelength range of at least equal to or greater than 390 nm and less than 410 nm, the transmittances Tp (45) and Ts (45) of light with an incident angle of 45 degrees are "equal to or less than 10%" of the transmittance T (0) of light with an incident angle of 0 degrees.

That is, a filter 42 with which the transmittance (second transmittance) of light (electromagnetic waves) with an incident angle of 45 degrees (second angle) which is a wavelength that cures the UV ink is equal to or less than 10% of the transmittance (first transmittance) of light with an incident angle of 0 degrees (first angle) which is a wavelength that cures the UV ink is provided on the ultraviolet irradiation unit 41 of Example 3.

Further, as illustrated in FIG. 5B, within a wavelength range of at least equal to or greater than 390 nm and less than 410 nm, the transmittances Tp (60), Ts (60), Tp (75), and Ts (75) of light with incident angles of 60 degrees and 75 degrees are also equal to or less than 10% of the transmittance T (0) of light with an incident angle of 0 degrees.

A filter 42 with such transmittances (characteristics of FIG. 5B) is formed by alternately overlapping thin films of $Nb_2O_5$ (niobium pentoxide) and thin films of $SiO_2$ (silicon dioxide) with the thicknesses illustrated in FIG. 4B up to 30 layers. Further, the refractive index of an $Nb_2O_5$ thin film is 2.409 at a wavelength of 395 nm, and the refractive index of an $SiO_2$ thin film is 1.454.

In the filter 42 that is provided on the ultraviolet irradiation unit 41 of Example 2, within a wavelength range of at least equal to or greater than 390 nm and less than 410 nm, the transmittance of light with an incident angle of 0 degrees (vertical light) is equal to or greater than 90%, and the transmittance of light with an incident angle of 45 degrees (diagonal light) is equal to or less than 30%. Furthermore, within a wavelength range of at least equal to or greater than 390 nm and less than 410 nm, the transmittances of light with an incident angle of 45 degrees is "equal to or less than 30%" of the transmittance T of light with an incident angle of 0 degrees. Furthermore, within a wavelength range of at least equal to or greater than 390 nm and less than 410 nm, the transmittances of light with incident angles of 60 degrees and 75 degrees are also equal to less than 30% of light with an incident angle of 0 degrees.

That is, a filter 42 in which the transmittance (second transmittance) of light with an incident angle of 45 degrees (second angle) which is a wavelength that cures the UV ink is equal to or less than 30% of the transmittance (first transmittance) of light with an incident angle of 0 degrees (first angle) which is a wavelength that cures the UV ink is provided on the ultraviolet irradiation unit 41 of Example 2.

Here, while the specific configuration of the filter 42 of Example 2 is not illustrated, as with the filter 42 of Examples 1 and 3, the filter 42 described above can be realized by adjusting the materials (refractive index), the film thicknesses, and the number of thin films that configure the filter 42.

In such a manner, while the filter 42 that is provided on the ultraviolet irradiation units 41 of Examples 1 to 3 transmits the vast majority (equal to or greater than 90%) of vertical light (light with an incident angle of 0 degrees), only a portion of diagonal light (in the embodiment, light with an incident angle of equal to or greater than 45 degrees) is transmitted (only equal to less than 50% of light in Example 1, equal to or less than 30% of light in Example 2, and equal to or less than 10% in Example 3 is transmitted). That is, a filter 42 with a large difference in the transmittance of vertical light and the transmittance of diagonal light is provided on the ultraviolet irradiation unit 41 of the embodiment, wherein the difference is greatest in Example 3 and the difference is next greatest in Example 2.

Evaluation Results

UV ink was discharged from the nozzle opening Nz toward the medium S that passes below the head 31, and light (ultraviolet rays) was irradiated from each ultraviolet irradiation units 41 of Comparative Example and Examples 1 to 3 onto the UV ink on the medium S that passes below each ultraviolet irradiation unit 41. As illustrated in FIG. 3A, "degree of cure of UV ink", "clogging of the nozzle", and "attachment amount of UV ink on nozzle opening face" were then evaluated. Here, due to the ink mist that is generated during printing, UV ink is attached to the nozzle face (lower face) of the head 31. The nozzle face of the head 31 is therefore normally wiped off by a wiper intermittently. Furthermore, the attachment amount of the UV ink on the nozzle opening face is the amount of UV ink that is attached to the nozzle face after the nozzle face of the head 31 is wiped off by the wiper, that is, the amount of UV ink that could not be wiped off by the wiper.

For "degree of cure of UV ink", a normal evaluation (○) was given to all ultraviolet irradiation units 41. That is, the UV ink on the medium S can be sufficiently cured for the ultraviolet irradiation unit 41 of Comparative Example as well as the ultraviolet irradiation units 41 of Examples 1 to 3.

For "clogging of nozzle", an evaluation that there is clogging (x) was given to the ultraviolet irradiation unit 41 of Comparative Example, and an evaluation that there is no clogging was given to the ultraviolet irradiation units 41 of Examples 1 to 3. Further, an evaluation that the degree of cure (thickness) of the UV ink in the nozzle openings and the nozzle was low was given in order of Example 3 (very good ⊙), Example 2 (good ○), and Example 1 (normal ○).

For the "attachment amount of UV ink on nozzle opening face", similarly to the clogging of the nozzle, an evaluation that there is a large attachment amount of UV ink was given to the ultraviolet irradiation unit 41 of Comparative Example, and an evaluation that the attachment amount of UV ink was less was given in order of Example 3 (very good ⊙), Example 2 (good ○), and Example 1 (normal ○).

When the ultraviolet irradiation unit 41 of Comparative Example is used, the nozzle may be clogged, or much of the UV ink that is attached to the nozzle face of the head 31 may not be wiped off even with the wiper. This is because, as illustrated in FIG. 6A, the filter 42 that suppresses the transmission of diagonal light is provided in the ultraviolet irradiation unit 41. In such a case, diagonal light that is reflected by the medium S and the transport belt 22 reaches the nozzle face of the head 31. In so doing, the light (ultraviolet rays) that reaches the nozzle face can thicken or cure the UV ink in the vicinity of the nozzle and the UV ink that is attached to the nozzle face.

When the UV ink in the vicinity of the nozzle is thickened or is cured, the nozzle is clogged, the regulated amount of UV ink cannot be discharged when the ink is to be discharged from the nozzle, and the image quality of the print image deteriorates. Further, it is necessary to increase the number of times that the nozzle is cleaned in order to recover the clogged nozzle, wastefully consuming UV ink.

Further, when the UV ink that is attached to the nozzle face is thickened or is cured, and the UV ink is attached to the nozzle face, the UV ink can no longer be wiped off by the wiper. The UV ink is then deposited on the nozzle face, and the medium S that passes below the head 31 (nozzle face) is stained by the UV ink.

Further, by arranging the head 31 and the ultraviolet irradiation unit 41 to be apart in the transport direction, diagonal light that is reflected by the medium S or the transport belt 22 is prevented from reaching the nozzle face of the head 31, and clogging of the nozzle and the solidifying of the UV ink on the nozzle face is prevented. However, the gap between the head 31 and the ultraviolet irradiation unit 41 increases, causing the printer 1 to increase in size.

On the other hand, as illustrated in FIG. 6B, the filter 42 that suppresses the transmission of diagonal light is provided on the ultraviolet irradiation units 41 of Examples 1 to 3. Specifically, within a wavelength range that cures the UV ink, the filter 42 of Example 1 only transmits equal to or less than 50% of diagonal light, the filter 42 of Example 2 only transmits equal to or less than 30% of diagonal light, and the filter 42 of Example 3 only transmits equal to or less than 10% of diagonal light.

Therefore, in a case when the ultraviolet irradiation units 41 of Examples 1 to 3 are used, even when diagonal light is irradiated from the LED package, the vast majority of the diagonal light is reflected by the filter 42 as illustrated in FIG. 6B, and only a portion of the diagonal light can transmit through the filter 42. Therefore, in Examples 1 to 3, compared to Comparative Example, it is possible to significantly reduce the amount of diagonal light (ultraviolet rays) that is reflected from the medium S and the transport belt 22 and reaches the nozzle face of the head 31. The UV ink in the vicinity of the nozzle is therefore prevented from being thickened or cured, and clogging of the nozzle can be prevented.

On the other hand, with the filter 42 that is provided on the ultraviolet irradiation units 41 of Examples 1 to 3, the vast majority of vertical light is transmitted. Specifically, within a wavelength range that cures the UV ink, the filter 42 of each of Examples 1 to 3 transmits equal to or greater than 90% of vertical light. Therefore, due to the large amount of vertical light that is transmitted through the filter 42, the UV ink on the medium S is sufficiently cured.

That is, a filter 42 with a transmittance (first transmittance, transmittance equal to or higher than 90% in the example) that enables the UV ink on the medium S to be cured with respect to vertical light (electromagnetic waves) that is incident with an incident angle of 0 degrees (first angle) and with a transmittance (second transmittance) that maintains a state in which the nozzle can discharge the UV ink with respect to diagonal light that is incident with an incident angle of equal to or greater than 45 degrees (second angle) is provided on the ultraviolet irradiation units 41 of Examples 1 to 3.

Furthermore, in the filters 42 of Examples 1 to 3, the transmittance of diagonal light (second transmittance) is less than the transmittance of vertical light (first transmittance). That is, the ratio of the transmittance of diagonal light with respect to the transmittance of vertical light is low (equal to or less than 50% in Example 1, equal to or less than 30% in Example 2, and equal to or less than 10% in Example 3). In so doing, the amount of light (ultraviolet rays) that is reflected by the medium S and the like and reaches the nozzle face can be decreased without much reducing the amount of light (ultraviolet rays) that is irradiated on the UV ink on the medium S.

In other words, the ultraviolet irradiation unit 41 (irradiator) of the embodiment includes a light source (here, an LED) that can irradiate ultraviolet rays for curing the UV ink and a filter 42 that transmits the ultraviolet rays, where, the filter 42 has a predetermined transmittance (first transmittance) with respect to the ultraviolet rays (vertical light) that are incident at 0 degrees (first angle) and a transmittance (second transmittance) that is less than the predetermined transmittance with respect to the ultraviolet rays (diagonal light) that is incident at 45 degrees (second angle).

According to the printer 1 that includes such an ultraviolet irradiation unit 41, since the UV ink on the medium S is sufficiently cured, bleeding and peeling of the UV ink can be prevented, and a deterioration in the quality of the printing image can be prevented. Further, since the clogging of the nozzle can be prevented, the regulated amount of UV ink can be discharged from the nozzle during printing, and a deterioration in the image quality of the printing image can be prevented. Further, an increase in the number of times that the nozzle is cleaned can also be suppressed.

Further, since the transmittance of diagonal light is low and the amount of light (ultraviolet rays) that reaches the nozzle face of the head 31 through reflection is small, thickening or curing of the UV ink that is attached to the nozzle face of the head 31 can be prevented. It is therefore possible to wipe off the UV ink that is attached to the nozzle face of the head 31 using a wiper, and the medium S is prevented from being stained by the UV ink that accumulates on the nozzle face.

Further, in the Examples 1 to 3, since the amount of light (ultraviolet rays) that reaches the nozzle face of the head 31 is reduced by providing the filter 42 on the irradiation units 41, there is no need to increase the gap between the head 31 and the ultraviolet irradiation unit 41, allowing the printer 1 to be miniaturized. It is therefore possible to arrange the head 31 and the ultraviolet irradiation unit 41 to be close together, allowing the printer 1 to be miniaturized. In other words, since there is no need to increase the gap between the head 31 and the ultraviolet irradiation unit 41, the degree of freedom of the arrangement of the head 31 and the ultraviolet irradiation unit 41 can be increased.

Further, filters 42 with different ratios of the transmittance of diagonal light with respect to the transmittance of vertical light are used in each of Examples 1 to 3, wherein the ratio of Example 3 is the smallest and the ratio of Example 2 is next smallest. The smaller the ratio of the transmittance of diagonal light with respect to the transmission of vertical light, the amount of light (ultraviolet rays) that is reflected by the medium S and the like and reaches the nozzle face of the head 31 can be reduced.

Therefore, the smaller the ratio between the transmission of diagonal light with respect to the transmittance of vertical light (Example 3 compared to Example 1), the lower the degree of cure of the UV ink that is attached in the vicinity of the nozzle and on the nozzle face, clogging of the nozzle can be more reliably prevented, and the amount of UV ink that is attached to the nozzle face after being wiped off by the wiped can be reduced further.

Further, as illustrated in FIGS. 5A and 5B, in the filters 42 of Examples 1 to 3, the transmittance of light with a wavelength of equal to or greater than 350 nm and less than 380 nm with an incident angle of 45 degrees is greater than the transmittance of light with a wavelength of equal to or greater than 390 nm and less than 410 nm with an incident angle of 45 degrees. That is, even with diagonal light, the transmittance outside a wavelength range that acts on the curing of the UV ink (here, a wavelength that is shorter than a wavelength range that acts on the curing of the UV ink, equal to or greater than 350 nm and less than 380 nm) is caused to be greater than the transmittance with a wavelength that acts on the curing of the UV ink (here, equal to or less than 390 nm and less than 410 nm). That is, diagonal light that does not act on the UV ink is transmitted through the filter 42.

When the temperature of the LED package rises, the light emitting efficiency may decrease and the life of the LED package may shorten. It is therefore preferable that as much light as possible be transmitted through the filter 42 to reduce the amount of heat that is trapped between the filter 42 and the LED package. Therefore, with the filter 42 of the embodiment, as described above, the transmittance of diagonal light outside of a wavelength range that acts on the curing of the UV ink is made to be greater than the transmittance of diagonal light of a wavelength that acts on the curing of the UV ink.

In so doing, it is possible to reduce the amount of heat that is trapped between the filter 42 and the LED package, and a rise in temperature in the vicinity of the LED package can be suppressed. It is therefore possible to use the LED package over the long term while maintaining the light emitting efficiency of the LED package. Further, the need to provide a heat releasing means on the ultraviolet irradiation unit 41 is eliminated, decreasing cost.

Further, even when diagonal light that does not act on the curing of the UV ink is transmitted through the filter 42, reflected by the medium S and the like, and reaches the nozzle face of the head 31, the UV ink that is attached in the vicinity of the nozzle and the nozzle face is not thickened or cured. There are therefore no problems even when the transmittance of diagonal light outside of a wavelength range that acts on the curing of the UV ink is increased.

That is, according to the filter 42 of the embodiment, thickening and curing of the UV ink that is attached in the vicinity of the nozzle and the nozzle face can be prevented while suppressing an increase in the temperature of the ultraviolet irradiation unit 41.

Further, it is preferable that a hydrophobic and oil-repellent treatment be performed on the surface of the filter 42 on the medium S side (glass base material). In so doing, even when the ink mist that is generated during printing attaches to the surface of the filter 42, the UV ink can be easily wiped off by a wiper, and the amount of UV ink that is attached to the surface of the filter 42 can be reduced. As a result, vertical light that is irradiated from the LED package can be reliably irradiated on the UV ink on the medium S, and the UV ink on the medium S can be reliably cured.

Further, while an embodiment in which light with an incident angle of equal to or greater than 45 degrees is diagonal light and the transmittance of light with an incident angle of equal to or greater than 45 degrees is made to be low has hitherto been described, the invention is not limited thereto. Even with an incident angle of less than 45 degrees, light may be reflected by the medium S and the like and reach the nozzle face of the head 31. Further, while an embodiment in which the transmittance of vertical light with an incident angle of 0 degrees is made high has been described, there are cases where even light with an incident angle greater than 0 degrees only acts to cure the UV ink on the medium S without reaching the nozzle face of the head 31. Therefore, it is preferable that a filter 42 with a transmittance that can cure the UV ink on the medium S with respect to light that is incident at an angle that does not reach the nozzle face of the head 31 (first angle) and a transmittance that maintains the nozzle to be in a state of being able to discharge UV ink with respect to light that is incident at an angle that reaches the nozzle face of the head 31 (second angle) be provided on the ultraviolet irradiation unit 41.

Other Embodiments

While the embodiment described above mainly described an image recording apparatus, the embodiment described above is to aid understanding of the invention, and is not to be interpreted as limiting the invention. Needless to say, the invention may be modified or improved without departing from the gist thereof, and equivalents are included in the invention.

On Ink

While an image recording apparatus that uses ultraviolet curable ink (UV ink) is exemplified in the embodiment described above, without being limited thereto, the image recording apparatus may use ink that is cured when electromagnetic waves such as, for example, X-rays and visible light are irradiated.

On Printer

While a printer 1 in which the medium S passes below the fixed head 31 and the ultraviolet irradiation unit 41 is exemplified in the embodiment described above, the invention is not limited thereto. For example, there may be a printer that repeats an operation of discharging ink from the head while moving the head and the irradiator in a predetermined direction and an operation of transporting the medium in a direction that intersects a predetermined direction, or a printer that repeats an operation of discharging ink from the head while moving the head and the irradiator in a predetermined direction and an operation of moving the head and the irradiator in a direction that intersects the predetermined direction.

The entire disclosure of Japanese Patent Application No. 2011-177677, filed Aug. 15, 2011 is expressly incorporated by reference herein.

What is claimed is:

1. An image recording apparatus comprising:

a nozzle that discharges electromagnetic wave curable ink that is cured when an electromagnetic wave is irradiated onto a recording medium;

an irradiator for irradiating the electromagnetic wave, wherein a filter that transmits the electromagnetic wave is provided on the irradiator, and wherein a transmittance by the filter of diagonal light of the electromagnetic wave that is outside of a wavelength range that acts on the curing of the electromagnetic wave curable ink is greater than a transmittance by the filter of diagonal light of the electromagnetic wave that is of a wavelength that acts on the curing of the electromagnetic wave curable ink.

2. The image recording apparatus according to claim 1, wherein in a case where the first angle is 0 degrees and the second angle is 45 degrees, the second transmittance is equal to or less than 50% of the first transmittance.

3. The image recording apparatus according to claim 1, wherein in a case where the first angle is 0 degrees and the second angle is 45 degrees, the second transmittance is equal to or less than 30% of the first transmittance.

4. The image recording apparatus according to claim 1, wherein in a case where the first angle is 0 degrees and the second angle is 45 degrees, the second transmittance is equal to or less than 10% of the first transmittance.

5. The image recording apparatus according to claim 1, wherein a wavelength of the electromagnetic wave is equal to or greater than 390 nanometers and less than 410 nanometers.

6. The image recording apparatus according to claim 1, wherein the filter is a multilayer filter.

7. The image recording apparatus according to claim 1, wherein in the filter, in a case where an angle of the incident electromagnetic wave is 45 degrees, the transmittance of an electromagnetic wave with a wavelength of equal to or greater than 350 nanometers and less than 380 nanometers is greater than the transmittance of an electromagnetic wave with a wavelength of equal to or greater than 390 nanometers and less than 410 nanometers.

8. The image recording apparatus according to claim 1, wherein the filter has a first transmittance when irradiated with an electromagnetic wave at an angle perpendicular to the plane, and a second transmittance when irradiated with an electromagnetic wave at an angle of 45 degrees to 75 degrees to the plane, and the second transmittance is less than the first transmittance.

9. An irradiator comprising:

a light source that can irradiate an electromagnetic wave for curing electromagnetic wave curable ink; and a filter that transmits the electromagnetic wave, wherein a transmittance by the filter of diagonal light of the electromagnetic wave that is outside of a wavelength range that acts on the curing of the electromagnetic wave curable ink is greater than a transmittance by the filter of diagonal light of the electromagnetic wave that is of a wavelength that acts on the curing of the electromagnetic wave curable ink.

10. An image recording apparatus including the irradiator according to claim 9.

* * * * *